US007082668B2

(12) United States Patent
Ando et al.

(10) Patent No.: US 7,082,668 B2
(45) Date of Patent: Aug. 1, 2006

(54) ELECTRO-ACOUSTIC TRANSDUCER HAVING VIBRATING FUNCTION AND METHOD OF MANUFACTURING THE SAME

(75) Inventors: Kimihiro Ando, Mie (JP); Kenichi Ajiki, Mie (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/380,281

(22) PCT Filed: Oct. 24, 2002

(86) PCT No.: PCT/JP02/11062

§ 371 (c)(1),
(2), (4) Date: Aug. 8, 2003

(87) PCT Pub. No.: WO2004/039122

PCT Pub. Date: May 6, 2004

(65) Prior Publication Data

US 2004/0081331 A1 Apr. 29, 2004

(51) Int. Cl.
*H04R 31/00* (2006.01)

(52) U.S. Cl. ..... 29/594; 381/162

(58) Field of Classification Search ..... 381/396, 381/398, 400, 401, 404, 412, 419, 420, 151, 381/96, 162, 411, 433, 386, 395; 340/388.1, 340/311.1; 29/594
See application file for complete search history.

(56) References Cited

U.S. PATENT DOCUMENTS

| | | | | |
|---|---|---|---|---|
| 6,529,611 | B1 * | 3/2003 | Kobayashi et al. | 381/396 |
| 6,553,125 | B1 * | 4/2003 | Kobayashi et al. | 381/396 |
| 7,003,130 | B1 * | 2/2006 | Chung | 381/396 |
| 2005/0047621 | A1 * | 3/2005 | Cranfill et al. | 381/396 |

FOREIGN PATENT DOCUMENTS

| | | |
|---|---|---|
| JP | 2000-153231 | 6/2000 |
| JP | 2000-217182 | 8/2000 |
| JP | 2001-239211 | 9/2001 |
| JP | 2002-186074 | 6/2002 |

* cited by examiner

*Primary Examiner*—Sinh Tran
*Assistant Examiner*—Walter F Briney, III
(74) *Attorney, Agent, or Firm*—Wenderoth, Lind & Ponack, L.L.P.

(57) ABSTRACT

A mechanical resonance frequency of a vibration section of an electro-acoustic transducer having a vibrating function is measured during an assembly process, and is compared with a predetermined mechanical resonance frequency. Based on a difference obtained by this comparison, a weight to be attached and a position for fixing a vibration section to a frame is determined. In accordance with this determination, the weight for resonance frequency adjustment is attached to the vibration section, or suspension and the frame which have been provisionally fixed are fixed again. Thus, the predetermined mechanical resonance frequency can be obtained steadily. As a result, an electro-acoustic transducer having a vibrating function with stabilized mechanical resonance frequency of the vibration section can be produced.

5 Claims, 4 Drawing Sheets

ELECTRO-ACOUSTIC TRANSDUCER HAVING VIBRATING FUNCTION AND METHOD OF MANUFACTURING THE SAME

This application is a National Stage of PCT/JP02/11062, filed Oct. 24, 2002.

TECHNICAL FIELD

The present invention relates to an electro-acoustic transducer having a vibrating function, and a method for manufacturing the transducer.

BACKGROUND ART

A conventional electro-acoustic transducer having a vibrating function (hereinafter referred to as a transducer) is disclosed in Japanese Patent Laid-Open Application No. 2000-153231. This conventional transducer is described referring to FIGS. 5A and 5B. FIG. 5A is a plan view and FIG. 5B is a cross sectional view.

Referring to FIGS. 5A and 5B, the transducer's voice coil 10*a* is fixed to a diaphragm 10. A magnetic circuit 11 comprises a magnetic circuit portion 11*a* which generates a driving power by flowing an electric current in voice coil 10*a*, and a weight portion 11*b* which is integrated with the magnetic circuit portion 11*a*. The weight portion 11*b* is added for a purpose of sensing vibration of vibration section 13, which will be referred to later. If the vibration section 13 generates sufficient vibration, the weight portion 11*b* can be omitted.

Magnetic circuit portion 11*a* and weight portion 11*b* are supported by a frame 16 via a suspension 12. Vibration section 13 comprises magnetic circuit 11 and suspension 12. Diaphragm 10 and voice coil 10*a* constitute a mechanical resonance circuit of an acoustic section. Magnetic circuit 11 and suspension 12 constitute a mechanical resonance circuit of vibration section 13.

Weight portion 11*b* is a molded resin containing tantalum powder, and suspension 12 and magnetic circuit portion 11*a* are integrated with the weight portion 11*b* through an insert molding process to provide a one-piece component. A baffle 17 is bonded to a periphery of diaphragm 10, and attached to frame 16.

Now, operation of the above-configured electro-acoustic transducer having a vibrating function is described below.

As voice coil 10*a* is disposed in a magnetic gap A of magnetic circuit portion 11*a*, when an AC current is applied, voice coil 10*a* generates a driving force. Since a weight of voice coil 10*a* is very small relative to that of magnetic circuit 11, magnetic circuit 11 does not vibrate at most frequency ranges, while voice coil 10*a* alone vibrates. Thus, diaphragm 10 is vibrated by voice coil 10*a* to generate sounds at most frequency ranges.

Since vibration section 13 is for sensing vibration of a human body, a mechanical resonance frequency of vibration section 13 is set at a certain frequency that is lower than that of the acoustic section. Mechanical impedance of vibration section 13 becomes smallest at the mechanical resonance frequency. Therefore, even with a small driving force, vibration section 13 can generate a vibration large enough to be sensed by the human body. Vibration force at this time is determined by a product of vibration section 13's weight (that is a weight of magnetic circuit 11, in an approximation) and acceleration of vibration section 13.

In the conventional transducer having a vibration function operating in accordance with the above-described principle, the mechanical resonance circuit comes to have a high resonance sharpness Q in order to vibrate vibration section 13 which has a large mass. As a result, vibration section 13's mechanical resonance frequency disperses largely relative to resonance frequency signals delivered to voice coil 10*a* from outside for vibrating vibration section 13. This dispersion leads to problematical dispersion of vibrating force. Dispersion in mechanical resonance frequency is caused by weight dispersion of vibration section 13, dispersion in material thickness, width, Young's modulus, and the like of suspension 12, and supporting position dispersion of suspension 12 and other factors.

The present invention addresses the above problems and provides an electro-acoustic transducer having a vibrating function, wherein the mechanical resonance frequency of the vibration section can be adjusted at low cost, and dispersion of vibrating force is reduced.

SUMMARY OF THE INVENTION

An electro-acoustic transducer having a vibrating function of the present invention comprises a diaphragm, a voice coil fixed to the diaphragm, a magnetic circuit provided with a magnetic gap in which the voice coil is inserted, and a vibration section provided with suspensions for connecting the magnetic circuit to a frame. Weight(s) for adjusting a resonance frequency of the vibration section is(are) attached to the vibration section based on a result of a measurement performed during a course of a production process, or the frame and the suspensions are connected at a plurality of connecting positions based on the above result. The weight (s) for adjusting the resonance frequency in the present invention is(are) attached so that the weight(s) do (does) not cause shift of a center of gravity of the vibration section.

BRIEF DESCRIPTION OF THE DRAWINGS

FIG. 5 B is a cross sectional view of the conventional transducer.

DESCRRIPTION OF THE PREFERRED EMBODIMENTS

Figure 1:
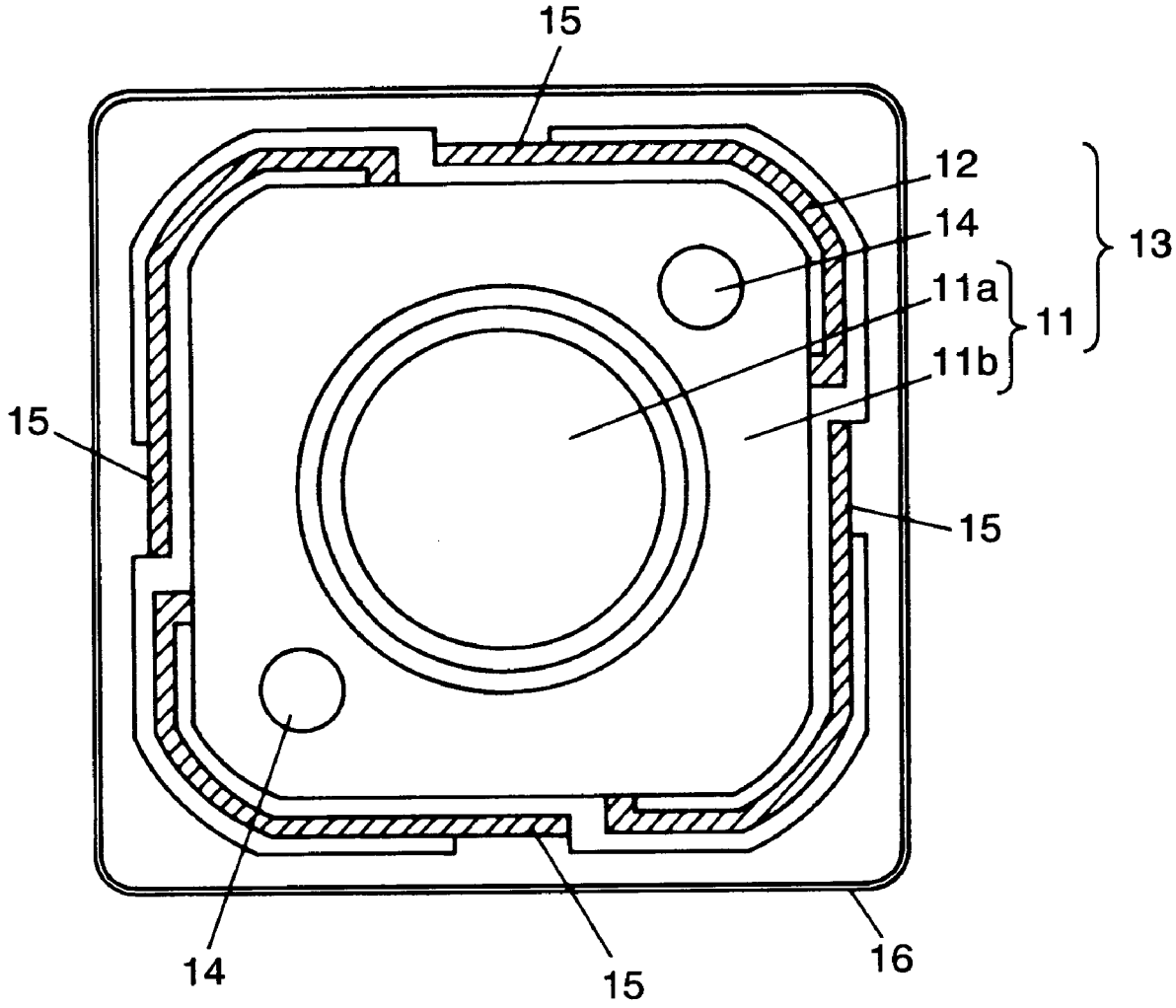
FIG. 1 shows a plan view of a vibration section (before a diaphragm is attached) of a transducer in accordance with an exemplary embodiment of the present invention.

An electro-acoustic transducer having a vibrating function of the present invention is described in the following in accordance with exemplary embodiments, referring to FIG. 1–FIG. 4. In the descriptions, those components identical to conventional technologies are represented by using the same reference numerals and their description is omitted.

First Embodiment

FIG. 1 shows a plan view of a vibration section, which is a key part of an electro-acoustic transducer having a vibrating function in accordance with an exemplary embodiment of the present invention. A main point of difference from conventional technology is that the transducer has weights for adjusting a resonance frequency attached to a weight portion.

Referring to FIG. 1, a magnetic circuit 11 comprises a magnetic circuit portion 11*a* and a weight portion 11*b* which does not practically function as a part of the magnetic circuit. The magnetic circuit 11 and a suspension 12 (hatched) form a vibration section 13.

Fixing portions 15 between frame 16 and suspension 12 are provided at four places in a symmetrical arrangement. Although in the present embodiment these are connected by adhesives, other methods such as a caulking, welding, brazing and the like may be employed. Suspension 12 and magnetic circuit portion 11*a* are formed integrally when weight portion 11*b* is formed by molding resin.

Weight portion 11*b* is provided with weights 14 for adjusting a mechanical resonance frequency at two places in order to adjust mechanical resonance frequency of vibration section 13. Weights 14 are aligned on a diagonal line passing through a center of gravity of magnetic circuit portion 11*a* and weight portion 11*b*. Therefore, the center of gravity after weights 14 are attached does not shift in a planar direction, and remains at the same position.

Positional arrangement(s) for weight(s) 14 is(are) not necessarily as described above, and a number of the weights may be one or the number may be more than one so long as the weight(s) do (does) not shift the center of gravity.

If the center of gravity shifts as a result of the positions of weight(s) 14, vibration section 13 is liable to cause a rolling motion when it vibrates.

Now, a process of manufacturing the transducer is described.

Initially, magnetic circuit 11 is fixed to frame 16 via suspension 12 to form vibration section 13. Then, voice coil 10*a* attached to dummy diaphragm 10, for example, is inserted into a magnetic gap of magnetic circuit portion 11*a*, and a dummy current is applied to voice coil 10*a*. Or, a mechanical resonance circuit of vibration section is vibrated by an external source. Through one of these operations, vibration section 13's mechanical resonance frequency is measured. Mechanical resonance frequency $f_0$ is calculated by the formula below:

$$f_0 = \tfrac{1}{2}\pi\sqrt{mc} \qquad \text{(Formula 1)}$$

Mass (weight) m of the vibration section is measured previously, and then using Formula 1, a value of weight 14 that should be attached to the vibration section for satisfying a predetermined resonance frequency can be calculated. This weight value is divided by a number of weight positions (two, in the present embodiment). Weights having this value are attached at respective positions by using adhesive or the like.

Then, real diaphragm 10 with voice coil 10*a* is attached to frame 16 with the voice coil 10*a* inserted into a magnetic gap of magnetic circuit 11. A transducer is thus produced.

The above-described manufacturing process can be performed on an assembly line, which can further be automated. Thus, the present invention enables highly efficient and stable production of transducers having a vibrating function, with vibration section 13 having a predetermined resonance frequency.

In the present embodiment, the mechanical resonance frequency of vibration section 13 is adjusted by adding weights 14. Therefore, a weight of vibration section 13 before attaching weights 14 has to be set to be slightly lighter than designed. This means that the mechanical resonance frequency is higher than a predetermined frequency. By so doing, the mechanical resonance frequency can be adjusted rather easily during an assembly process to be maintained within an allowable range of a predetermined mechanical resonance frequency.

In the present embodiment, descriptions are based on a case where an initial mechanical resonance frequency is measured in the course of assembling the transducer, and then weights 14 for adjustment are attached in accordance with this measured mechanical resonance frequency. Besides the above-described way of adjusting, there can be an alternative procedure. That is, weights 14 for adjustment can be attached through an opening provided in frame 16 at a place corresponding to a reverse side of weight portion 11*b*. With this procedure, resonance frequency adjustment can be made even after a transducer is finished, without using a dummy diaphragm. A further improvement of productivity can also be expected with this procedure.

Second Embodiment

Figure 2:
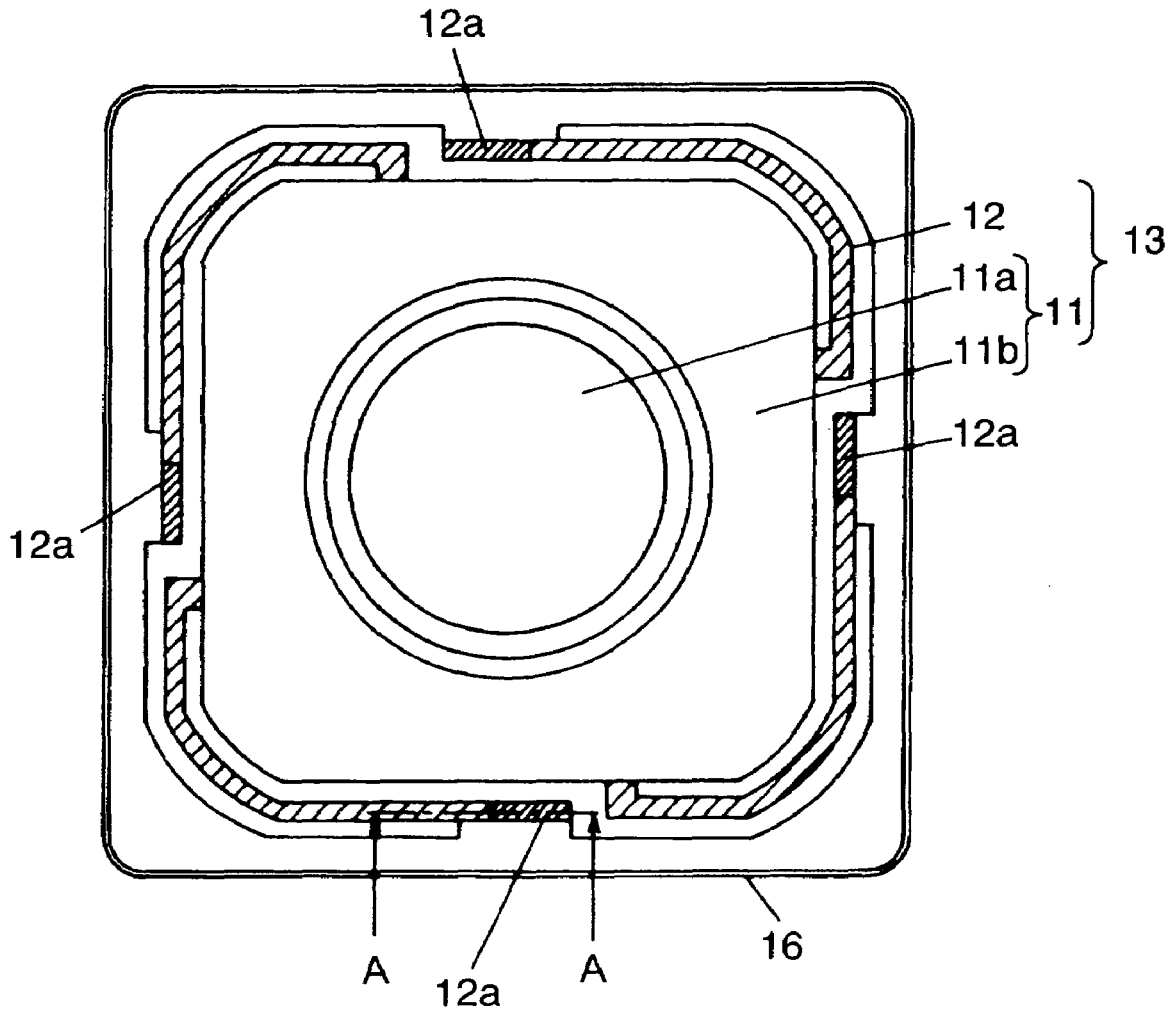
FIG. 2 shows a plan view of a vibration section (before a diaphragm is attached) of a transducer in accordance with another exemplary embodiment.
Figure 3:
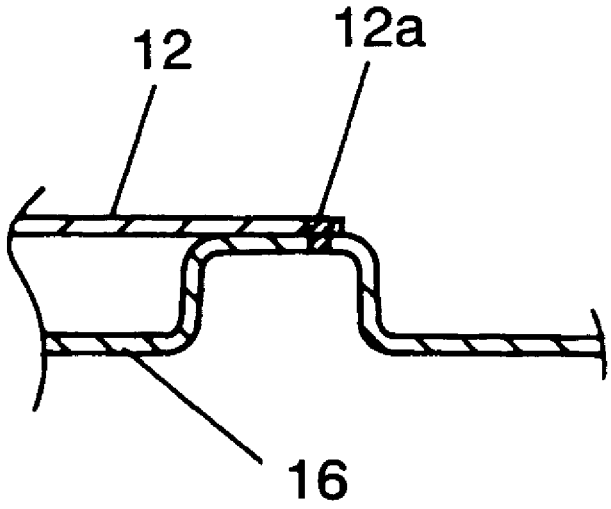
FIG. 3 is a cross sectional view showing a welding portion of a suspension and a frame.
Figure 4:
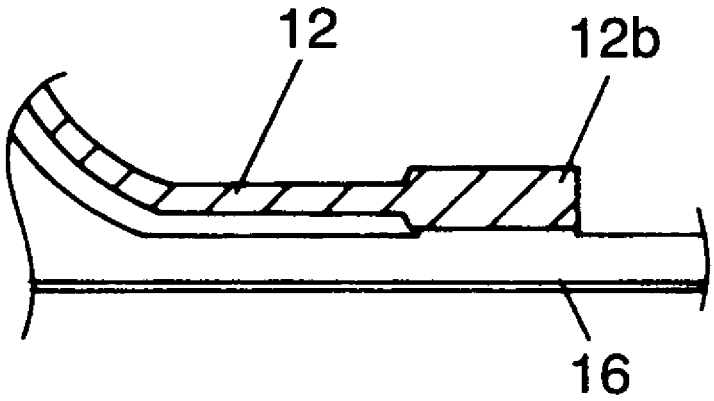
FIG. 4 is a plan view showing a welding portion of the suspension and the frame in another exemplary embodiment.
Figure 5A:
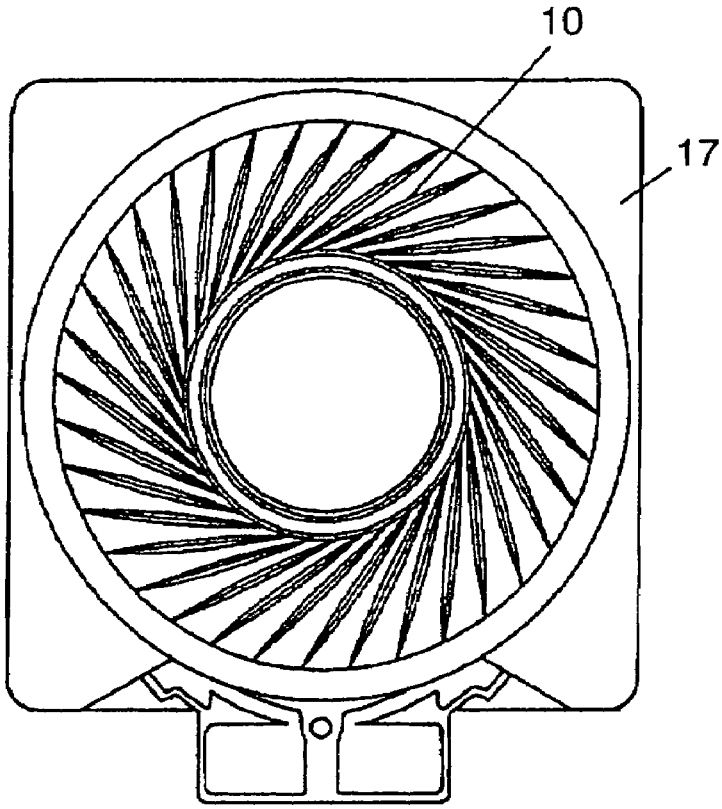
FIG. 5A PRIOR ART
FIG. 5 A is a plan view of a conventional transducer.
Figure 5B:
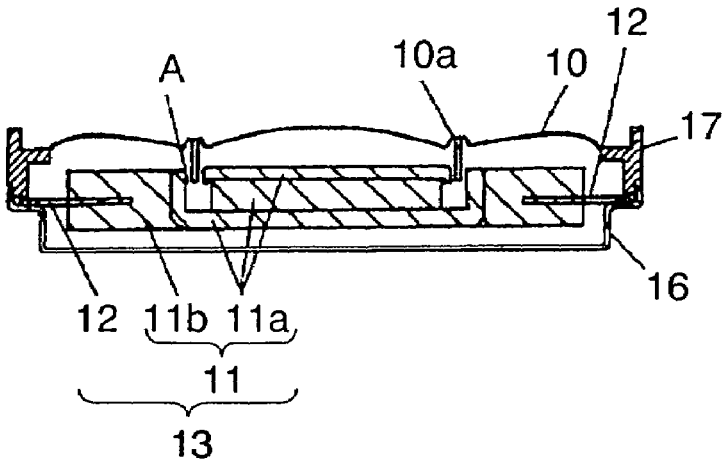
FIG. 5B PRIOR ART

FIG. 2 is a plan view of a vibration section of a transducer in a second exemplary embodiment. FIG. 3 is a cross sectional view of a welded portion of the vibration section. FIG. 4 is a plan view showing a welded portion of a vibration section of a modified exemplary embodiment.

Only a point of difference from the conventional technology is described with reference to FIG. 2. Suspension 12 and frame 16 in the present embodiment are connected by welding. Furthermore, regions 12*a* for welding are provided at four places each having a long length along a circumferential direction of suspension 12 around magnetic circuit 11.

Like in the first embodiment, a mechanical resonance circuit of vibration section 13 is completed, which is a half-finished stage before diaphragm 10 is attached. So, mechanic a1 resonance frequency can be measured. Therefore, the same procedure can be performed as with the first embodiment. Namely, a process for obtaining a predetermined mechanical resonance frequency is performed based on a difference between a mechanical resonance frequency measured by attaching dummy diaphragm 10 to voice coil 10*a* and a predetermined mechanical resonance frequency. In the present embodiment, welding positions between suspension 12 and frame 16 are calculated for obtaining the predetermined mechanical resonance frequency. In practice, suspension 12 and frame 16 are provisionally fixed together by welding, and then these members are welded again at a position obtained by the calculation to change an effective length of suspension 12 supporting the vibration section 13. The predetermined mechanical resonance frequency is thus obtained.

Since the mechanical resonance frequency is adjusted to the predetermined value by adding a welding place between suspension 12 and frame 16, a provisional welding position should be determined so that a mechanical resonance frequency is lower than the predetermined value. Described practically, provisional welding should be performed to leave a longer support for suspension 12, and then welding is performed again at a precise point after the mechanical resonance frequency is measured to obtain the predetermined mechanical resonance frequency. By so doing, the mechanical resonance frequency can be adjusted rather easily during an assembly process to be maintained within an allowable range of the predetermined mechanical resonance frequency.

In the above description, suspension 12 and frame 16 are finally welded at a stage where vibration section 13 is completed, but it is a stage still half-finished as a transducer. Besides the above-described way of adjusting, there can be an alternative procedure. That is, a final welding of suspension 12 and frame 16 can be performed through an opening provided in frame 16. With this procedure, the resonance frequency can be adjusted to the predetermined mechanical resonance frequency even after diaphragm 10 is attached and a appearance of the transducer is finished. With this procedure, operations of attaching and detaching a dummy diaphragm is eliminated, and improved productivity can be expected during production.

FIG. 4 shows a modified example of the present embodiment. Though, suspension 12 in the present embodiment extends in the circumferential direction to form a region 12*a* for welding, in the modified example the suspension is expanded also in a radial direction to widen region 12*b* for welding.

In a case where a welding position for obtaining a predetermined mechanical resonance frequency is very close to an initial welding position, the region 12*b* for welding which has been expanded also in the width direction provides a stable welding condition. For example, for a transducer of 20 mm square whose mechanical resonance frequency is approximately 120 Hz, a subtle adjustment of about 0.2–0.4 mm for shifting the resonance frequency by 2 Hz is required. A welding for such an adjustment might overlap on the provisional welding. The greater width of region 12*b* for welding wider than other part of the suspension makes small influence to a compliance of the whole suspension 12. This allows to set a large shift amount for the welding position. Thus, the configuration is effective to avoid overlapped welding.

The above descriptions have been based on a structure where suspension 12 is integrated with weight portion 11*b* by molding a resin to form a single component, and welding is performed only between frame 16 and suspension 12. However, the present invention is not limited to the above-described configuration. The weight portion 11*b* may be made of a metal such as iron that can be welded so that it can be welded to suspension 12. In this case, adjustment to the predetermined mechanical resonance frequency can be conducted between suspension 12 and weight portion 11*b*. However, it may be easier and more efficient to conduct a welding operation between frame 16 and suspension 12 with respect to productivity.

The foregoing descriptions of respective embodiments have been based on a procedure, where a mechanical resonance frequency of an individual vibration section of a transducer is measured after it is attached to a frame, and a difference from a predetermined mechanical resonance frequency is used for obtaining the predetermined mechanical resonance frequency. However, when magnetic circuits, suspensions and frames are available in a very steady condition, unitized vibration sections integrated with a magnetic circuit, weight portion and suspension can be supplied. In this case, at least one out of one lot of the supplied vibration section(s) is (are) sampled, and this sample is attached to a frame in the same manner as in the above embodiments to determine a weight for resonance frequency adjustment, or a locational shift for welding. And, production of electro-acoustic transducers having a vibrating function may be performed in accordance with determinations made in the above-described sampling process until a new variation factor arises.

Thus, an individual measurement for each transducer conducted in a process of production of an electro-acoustic transducer having a vibrating function for a purpose of obtaining a predetermined mechanical resonance frequency, determination of a weight for resonance frequency adjustment and determination of a welding position can be eliminated. This contributes to a substantial improvement of productivity.

Namely, in a state where supply conditions influential to a variation of resonance frequency, such as a suspension material thickness, weight of a magnetic circuit portion or the like are very stable, excluding typical lot-to-lot variations, the above-described production process utilizing the sampling measurement leads to a more efficient production.

INDUSTRIAL APPLICABILITY

In production of electro-acoustic transducers having a vibrating function, mechanical resonance frequency of the vibrating section can be stabilized in an efficient manner in accordance with the present invention. Thus, the present invention provides stable quality electro-acoustic transducers having a vibrating function at a low cost, and provides a great influence in industry.

The invention claimed is:

1. A method of manufacturing an electro-acoustic transducer having a vibrating function, comprising:

providing a vibration section including a magnetic circuit having a magnetic gap;

provisionally fixing said vibration section to a frame;

fixing a diaphragm, having a voice coil, to said frame while said voice coil is positioned within said magnetic gap;

determining a final fixing position of said vibration section relative to said frame by measuring a mechanical resonance frequency of said vibration section; and welding said vibration section to said frame based on the determined final fixing position.

2. The method according to claim 1, further comprising:

finishing an appearance of the electro-acoustic transducer prior to welding said vibration section to said frame.

3. The method according to claim 1, wherein provisionally fixing said vibration section to a frame comprises provisionally fixing said vibration section to said frame at a position such that a mechanical resonance frequency of said vibration section is lower than a predetermined mechanical resonance frequency of said vibration section.

4. The method according to claim 1, further comprising:

determining positions at which said vibration section is to be welded to said frame by determining positions at which said frame would be welded to a vibration section, sampled from a production lot of vibration sections, so as to obtain a desired resonance frequency, such that welding said vibration section to said frame comprises welding said vibration section to said frame at said positions.

5. The method according to claim 4, wherein said vibration section further has a magnetic circuit portion and a suspension, with said magnetic gap being in said magnetic circuit portion, and such that welding said vibration section to said frame comprises welding said suspension to said frame.

* * * * *